US006253673B1

(12) United States Patent
Chen

(10) Patent No.: US 6,253,673 B1
(45) Date of Patent: Jul. 3, 2001

(54) ILLUMINATING AND AUDIBLE INK STAMP

(75) Inventor: Chen-Yi Chen, Hsi Chih (TW)

(73) Assignee: Taiwan Stamp Enterprise Co., Ltd. (TW)

( * ) Notice: Subject to any disclaimer, the term of this patent is extended or adjusted under 35 U.S.C. 154(b) by 0 days.

(21) Appl. No.: 09/587,440

(22) Filed: Jun. 5, 2000

(51) Int. Cl.[7] ..... B41J 9/00
(52) U.S. Cl. ..... 101/98; 101/368; 101/405
(58) Field of Search ..... 101/98, 368, 405

(56) References Cited

U.S. PATENT DOCUMENTS 5,178,067 * 1/1993 Collier ..... 101/405
5,410,962 * 5/1995 Collier ..... 101/375
5,579,692 * 12/1996 Collier ..... 101/405
5,992,319 * 11/1999 Hsu ..... 101/368
6,032,580 * 3/2000 Lee ..... 101/368

* cited by examiner

*Primary Examiner*—John S. Hilten
*Assistant Examiner*—Charles H. Nolan, Jr.
(74) *Attorney, Agent, or Firm*—Dorsey & Whitney LLP

(57) ABSTRACT

The structure of an ink stamp emitting light and sounds has an LED and a speaker contained in a housing and electrically connected to a circuit board. When the ink stamp is pressed downward, the LED and the speaker will respectively give off light and sounds.

5 Claims, 5 Drawing Sheets

ILLUMINATING AND AUDIBLE INK STAMP

BACKGROUND OF THE INVENTION

1. Field of the Invention

The invention relates to an ink stamp which is able to give off light and sounds when being used.

2. Description of Related Art

Ink stamps are commonly used to repeatedly produce images or script but conventional stamps do not have ability to give off light and sounds during the printing process.

SUMMARY OF THE INVENTION

The main objective of the invention is to provide an ink stamp having the ability to emit light and sounds during a printing process through which a user can receive entertainment and enjoyment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
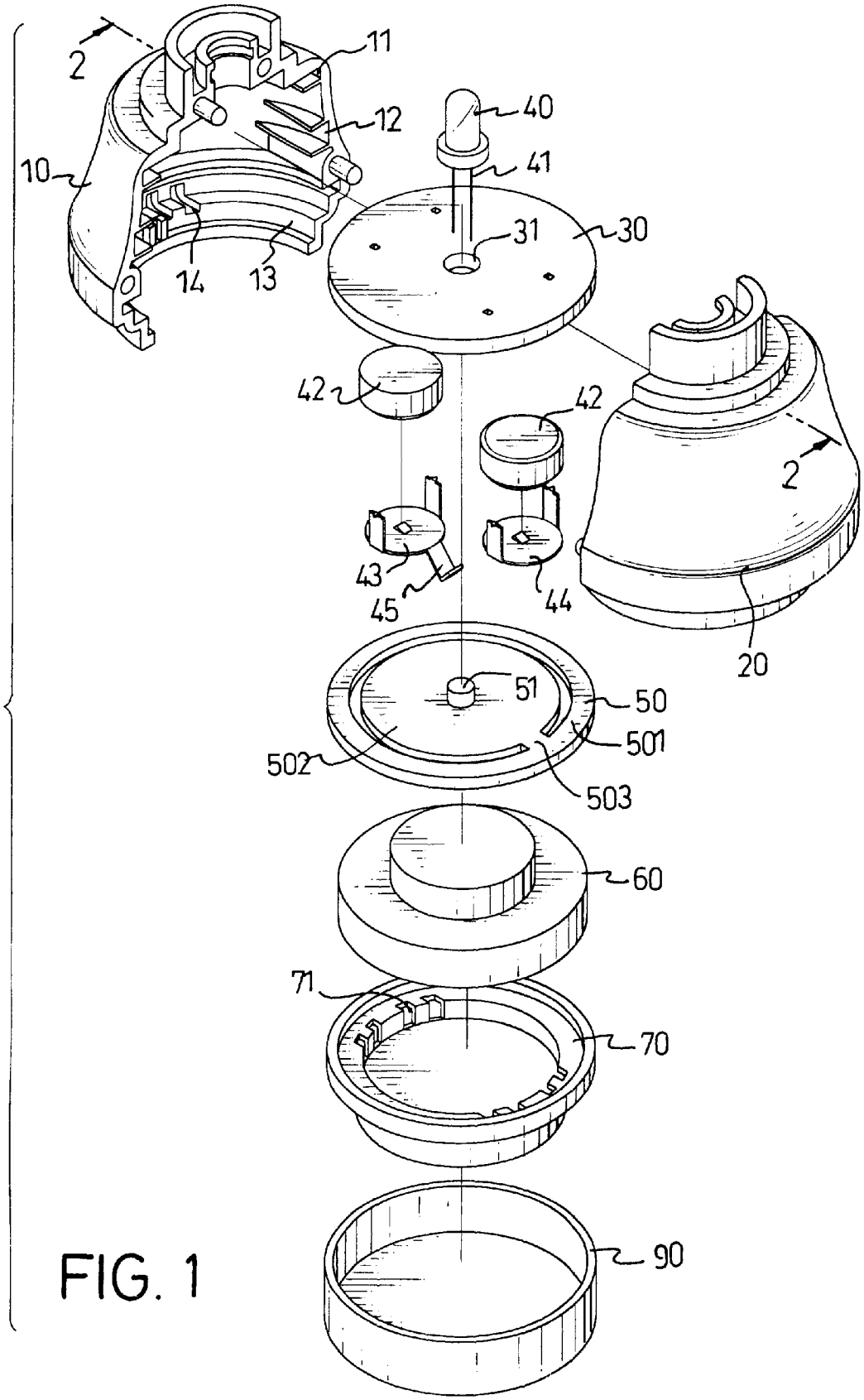
FIG. 1 is an exploded perspective view of an embodiment of the invention.
Figure 2:
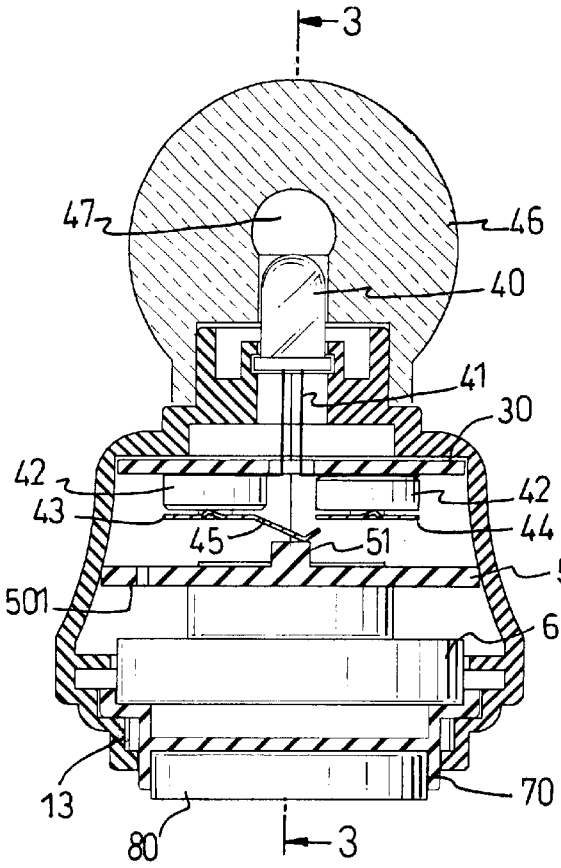
FIG. 2 is a cross-sectional view taken along 2—2 of the embodiment shown in FIG. 1.
Figure 3:
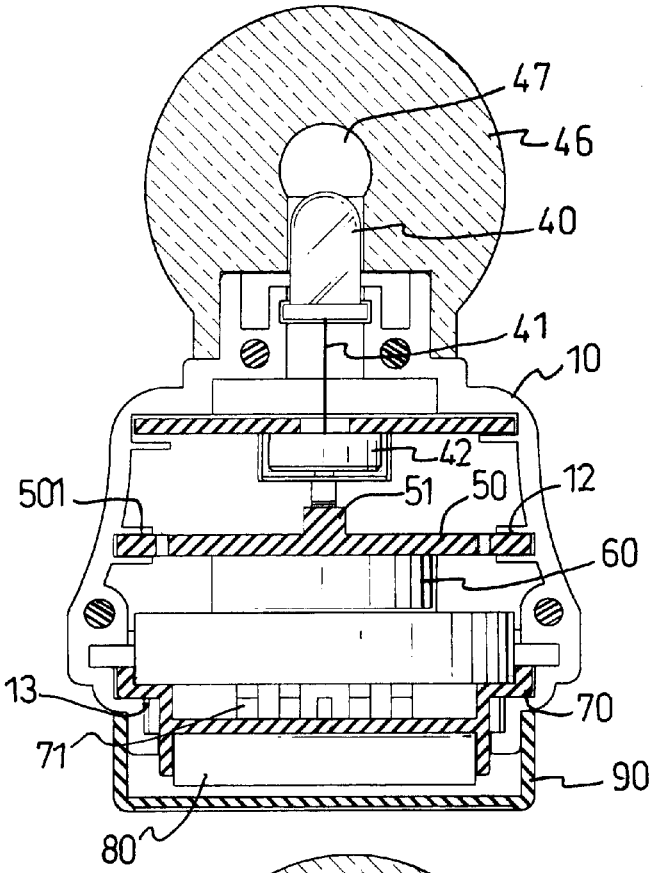
FIG. 3 is another cross-sectional view taken along 3—3 of the embodiment shown in FIG. 2.

Shown in FIGS. 1, 2, and 3 is the invention, an illuminating and audible ink stamp from which light and sounds are emittable.

The stamp includes a housing having a left half (10) and a right half (20) being able to be coupled together, a circuit board (30) having a central opening (31) and being contained in the housing and securely held there by an upper rack (11) formed on the housing. An LED (40) has two feet (41) inserted downwardly through the central opening (31). The two feet are fixed to the circuit board (30).

Two batteries (42) are respectively attached to the circuit board (30) by, and respectively electrically connecting to a first conductive clip (43) and a second conductive clip (44).

A V-shaped conductive leg (45) is formed on the first conductive clip (43) at one end thereof, with a free end disposed just under the second conductive clip (44), especially as shown in FIG. 2.An elastic board (50) is held by a pair of lower racks (12) sandwiching a rim (501) thereof. A central board (502) is provided in the rim (501) and connected to the rim (501) by a neck (503).

A central protrusion (51) is formed on the central board (502) and is disposed just under the conductive leg (45), as especially shown in FIG. 2.

A speaker (60) is disposed just under the elastic board (50), as especially shown in FIGS. 2 and 3.

A seat (70) is contained in the housing and is slidably held by a groove (13) defined in the housing.

The LED (40) protrudes from the housing so that light thereof can be seen. A transparent lampshade (46) having a central hollow (47) for containing the LED (40) is installed on the housing, as clearly shown in FIGS. 2 and 3.

At least one through opening (71) and a corresponding through opening (14) are defined respectively in an inner surface of the seat (70) and in a side wall forming the groove (13) so that sound emitted by the speaker (60) can pass therethrough. A rubber pad (80) having inscriptions thereon is attached to the seat (70) facing downward to form an ink stamp. A cover (90) detachably engages with the housing to protect the rubber pad (80) and keep it from becoming dry.

Figure 4:
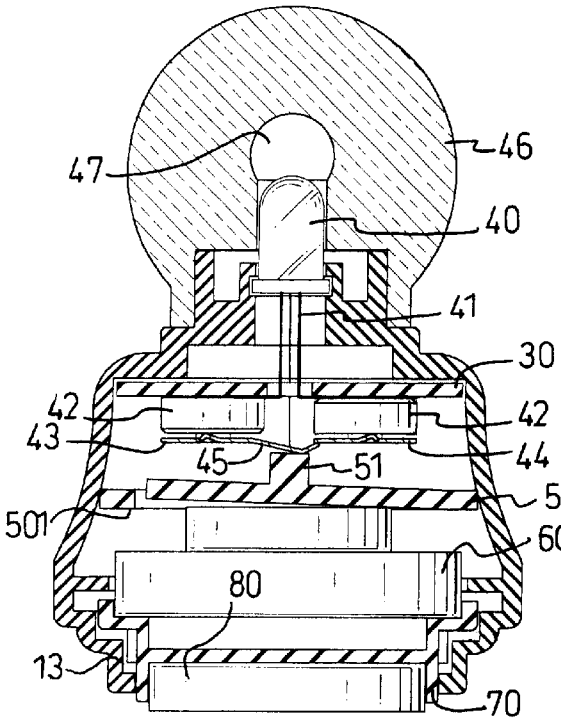
FIG. 4 is a cross-sectional view taken along 2—2 of the embodiment shown in FIG. 1 showing the operation of the invention.

In use, as shown in FIG. 4, a user can place the ink stamp at a position wanted and then press the housing downward. While printing on a paper, the rubber pad (80) will move upward with respect to the housing. This upward movement will also push the seat (70) and the speaker (60) contained in the seat upward with respect to the housing. The speaker (60) then pushes the central board (502), and the central protrusion (51) formed on the central board (502) accordingly, upward. The central protrusion (51) pushes the conductive leg (45) upward to meet the second conductive clip (44) whereby a circuit is completed to allow the LED (40) to emit light and the speaker (60) to emit sounds.

Figure 7:
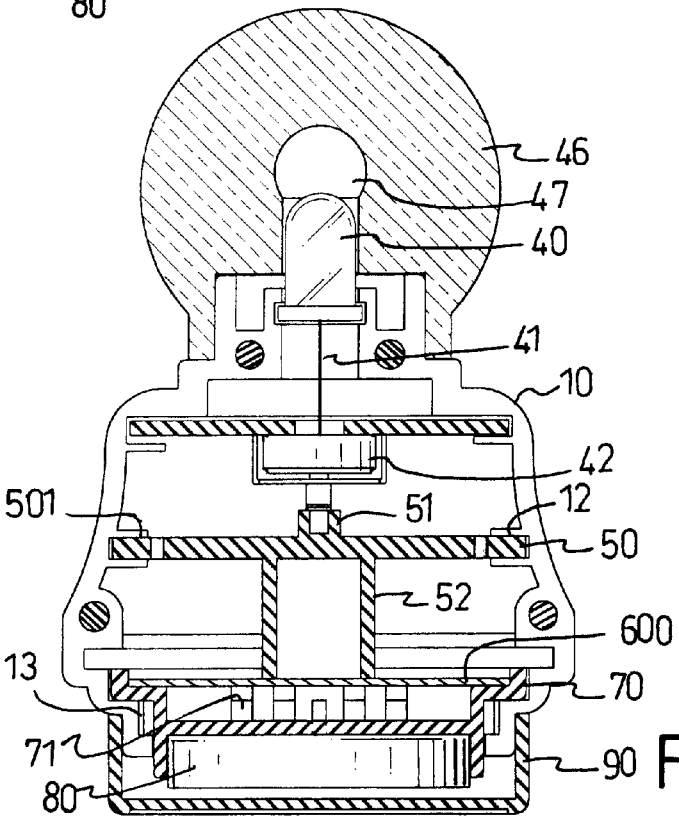
FIG. 7 is another cross-sectional view taken along 7—7 of the embodiment shown in FIG. 6; and, FIG. 8 is a cross-sectional view taken along 6—6 of the embodiment shown in FIG. 5 showing the operation of the invention.
Figure 5:
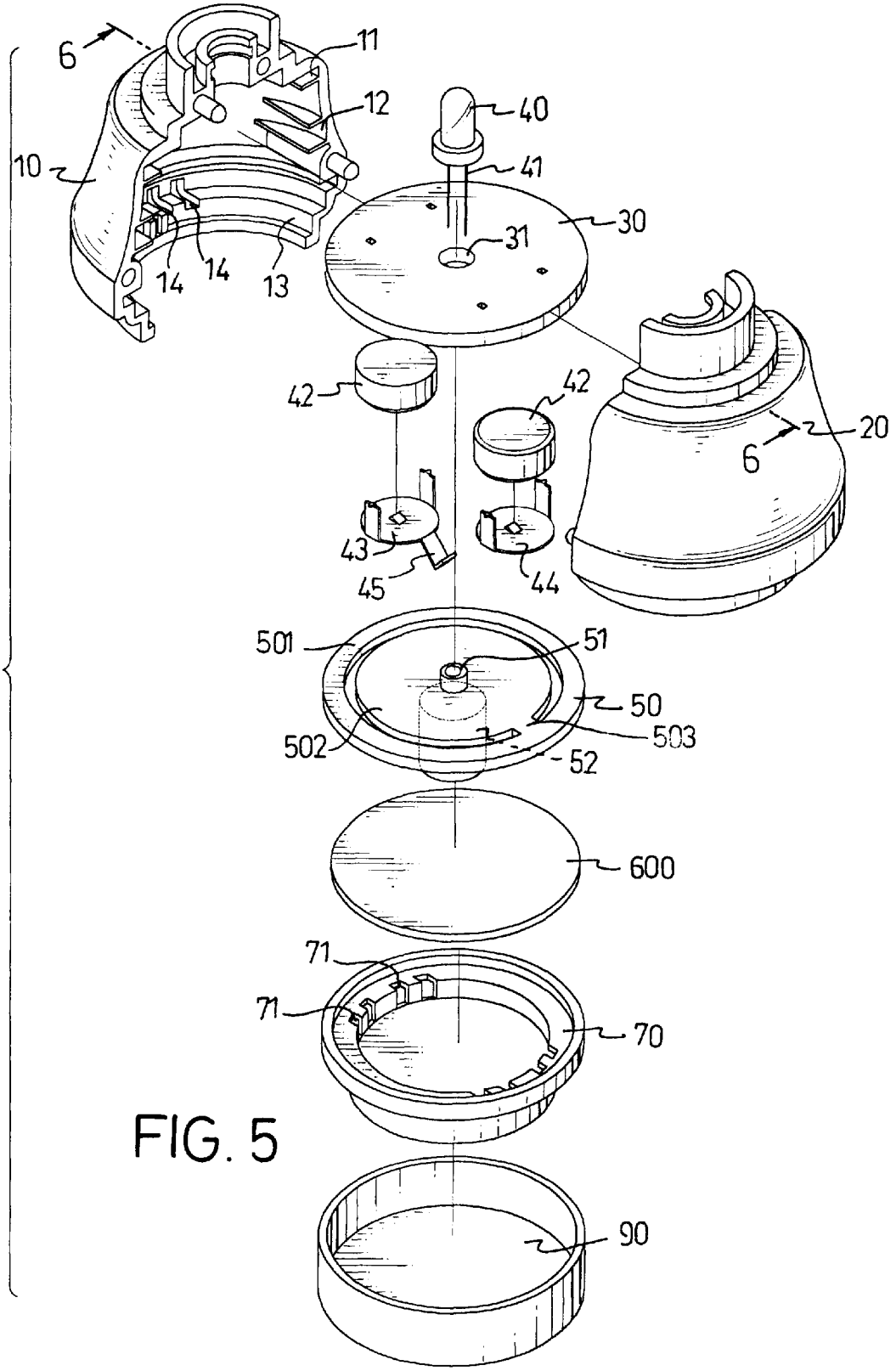
FIG. 5 is an exploded perspective view of another embodiment of the invention.
Figure 6:
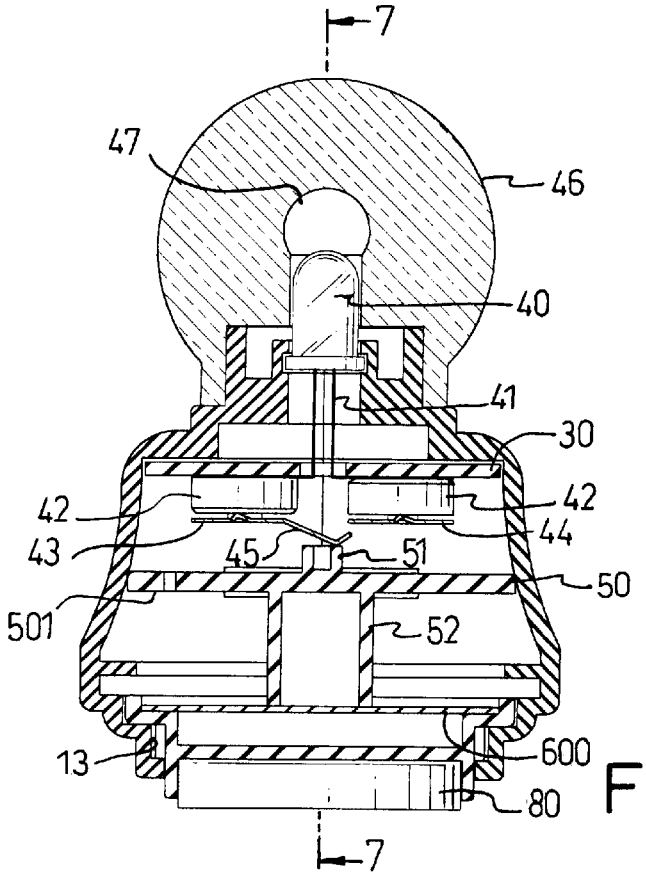
FIG. 6 is a cross-sectional view taken along 6—6 of the embodiment shown in FIG. 5.
Figure 8:
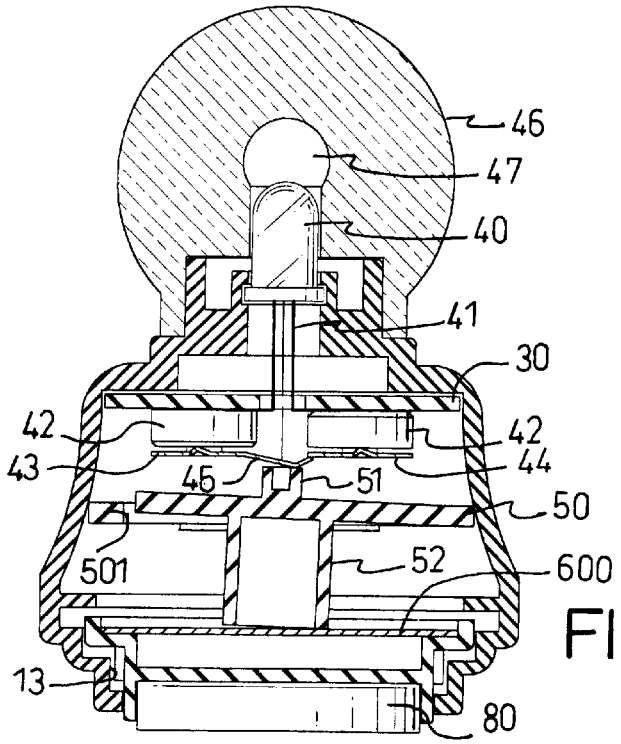

As in an embodiment shown in FIGS. 5 to 7, a lower central protrusion (52) is formed on a lower surface of the central board (502). With reference to FIG. 8, operation of the ink stamp of this embodiment is the same as the aforementioned one wherein the protrusion (52) will press a buzzer (600), in the same manner as the speaker (60) provided in the aforementioned embodiment, to emit sounds.

From above description, it could be understood that compared with the conventional ink stamp, the invention will be more fascinating to consumers as the stamp of the invention is able to give off light and sounds during a printing process.

What is claimed is:

1. An illuminating and audible ink stamp comprising:

a housing having two mating portions;

a circuit board having a central opening and being contained in the housing and securely held therein by an upper rack formed on the housing;

a light emitting device received in the central opening and conductively connected to the circuit board;

two batteries being respectively attached to the circuit board by, and respectively electrically connecting to a first conductive clip and a second conductive clip;

a leg formed on the first conductive clip at one end thereof, with a free end disposed under the second conductive clip;

an elastic board held by a pair of lower racks sandwiching a rim thereof, and having a central board being provided in the rim and connected to the rim by a neck, the central board having a lower central protrusion formed on a lower surface of the central board to press a buzzer to emit sound;

a central protrusion formed on the central board and being disposed under the leg;

a speaker disposed under the elastic board; and a seat contained in the housing and being slidably retained in a groove defined in the housing for containing the seat.

2. The illuminating and audible ink stamp as claimed in claim 1 wherein a transparent lampshade having a central hollow for containing the LED is installed on the housing.

3. The illuminating and audible ink stamp as claimed in claim 1, wherein at least one through opening and corresponding through opening are defined respectively in an inner surface of the seat and in a side wall forming the groove whereby sound emitted by the speaker can pass therethrough.

4. The illuminating and audible ink stamp as claimed in claim 1 further comprising a rubber pad attached to the seat and facing downward to form an ink stamp, wherein a cover detachably engagable with the housing is applied to accommodate the rubber pad to prevent the rubber pad from becoming dry.

5. The illuminating and audible ink stamp as claimed in claim 1, wherein a lower central protrusion is formed on a lower surface of the central board to press a buzzer to emit sounds.

* * * * *